US005336128A

United States Patent [19]

Birdsong

[11] Patent Number: 5,336,128

[45] Date of Patent: Aug. 9, 1994

[54] NAIL TECHNICIAN'S VENTILATOR

[76] Inventor: Esau Birdsong, 7841 Dallas Hwy., Douglas, Ga. 30134

[21] Appl. No.: 105,399

[22] Filed: Aug. 12, 1993

[51] Int. Cl.[5] ..... B08B 15/02

[52] U.S. Cl. ..... 454/56; 55/385.2

[58] Field of Search ..... 55/356, 385.2; 454/56, 454/65, 67

[56] References Cited

U.S. PATENT DOCUMENTS

| | | | |
|---|---|---|---|
| 3,267,830 | 8/1966 | Gaasbeek | 454/56 X |
| 4,312,291 | 1/1982 | Knab | 454/56 X |
| 4,553,992 | 11/1985 | Boissinot et al. | 454/67 X |
| 4,852,468 | 8/1989 | Harris . | |
| 5,112,373 | 5/1992 | Pham | 454/56 X |
| 5,125,939 | 6/1992 | Karlsson | 454/65 X |
| 5,181,883 | 1/1993 | Hofstra et al. | 454/57 X |

*Primary Examiner*—Harold Joyce
*Attorney, Agent, or Firm*—Deveau, Colton & Marquis

[57] ABSTRACT

A portable apparatus for removing fumes and vapors from the work area of a nail technician comprises a transparent hood having two semicircular end walls attached at opposite ends of a semicylindrical side wall so as to create a generally semicylindrical enclosure defining an interior chamber when placed on a flat surface. The side wall has an inner layer and an outer layer which is separated from the inner layer by a preselected distance so as to define a plenum therebetween. Both the inner layer and the outer layer have four portions defining hand openings for the insertion of hands of a nail technician and a customer. The inner layer has a plurality of apertures extending from the interior chamber to the plenum. The hood has at least one suction port in communication with the plenum, the suction port also being in communication with a source of reduced pressure by means of any convenient air passageway such as a hose. The invention optionally includes an in-line filter means connected between said at least one suction port and said source of reduced pressure as well as an air freshener means connected to an exhaust port of the source of reduced pressure, preferable a vacuum cleaner.

12 Claims, 3 Drawing Sheets

10
3
24
12
54
62
58
2
26
28
14
73
20
40
72
71
2
77
38
30
46
70
80
76
74
27
29
22
75
3
88
84
18
16
106

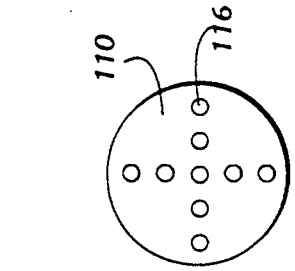
FIG. 5B
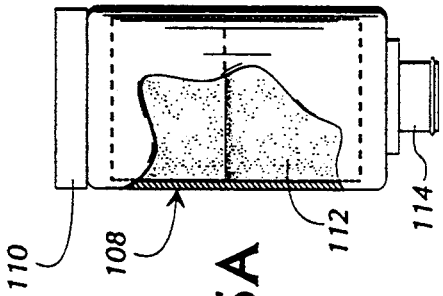
FIG. 5A
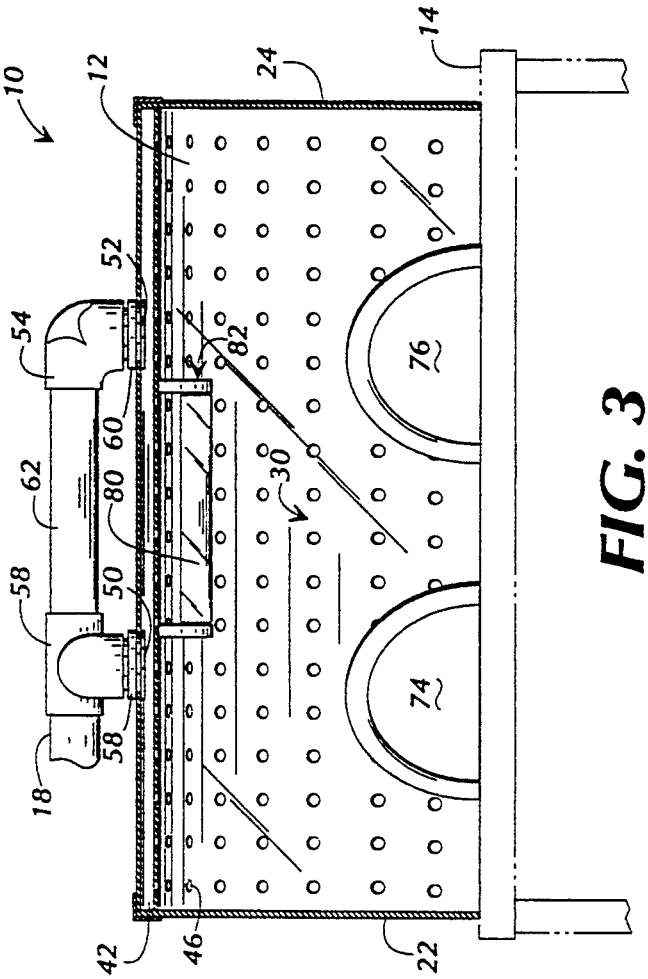
FIG. 3
FIG. 4
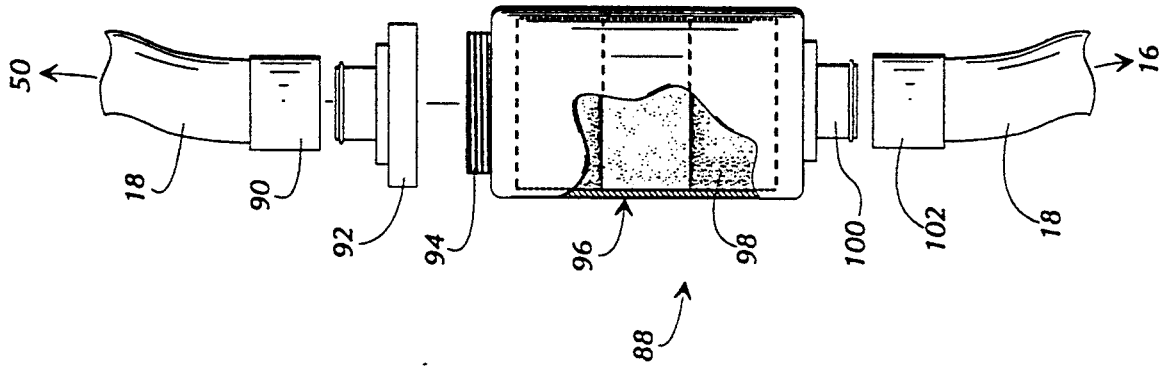

NAIL TECHNICIAN'S VENTILATOR

BACKGROUND OF THE INVENTION

1. Field of the Invention

The invention relates to a device for removing fumes and vapors from the work area of a nail technician.

2. Description of the Related Art

The hand and foot care industry has grown to be a multi-billion dollar industry with U.S. sales reaching a record 3.9 billion dollars in 1992. Including such services as manicures, application of artificial nails, and nail art, the industry appears to be headed for continued growth in our ever-increasingly fashion conscious society. Almost all states have licensing requirements which apply to the manicurist or nail technicians that work in the approximately 28,500 nail salons nationwide. Contributing to the growth of the sculptured nail industry is the fact that the average price for a set of sculptured nails is relatively high and can be even higher in the more exclusive salons which specialize in extra service and ambiance. Also, after an initial application of sculptured nails, a client may need to return to the salon every two weeks or so to have them touched-up and repaired, a process known as "filling".

A full set of nails can take up to one hour or more to complete. Before a sculptured nail can be applied, old color coats are removed and the natural nail surface is filed to created a rougher surface for better adhesion of the new nail. The natural nail surface is then sanitized with isopropanol and an acrylic primer is applied, which also promotes better adhesion. A removable mold or form is then attached to the finger nail, over which the sculptured nail is formed. The sculptured nail is formed entirely with a small brush applicator, which is dipped first into a liquid monomer, then dipped into a powder polymer containing a peroxide accelerator. The nail technician then forms the nail into the general shape before curing (hardening) takes place. Further refined shaping is accomplished by filing after curing. The nail is strengthened with thin fiberglass fabric. Cuticle oil is usually applied, and the nail is buffed. A base coat of primer is applied, followed by one or two color coats and a clear protective coat.

A variety of chemicals are used in the preparation, application, and maintenance of sculptured nails. Initially developed by dentists, the chemicals are the same as those that were used to make pink dental plastic for holding false teeth. The earlier nail products, some of which are still in use today, were not adequately modified for use on nails. Some of the chemicals used in applying sculptured nails include methyl and ethyl methacrylate, acetone, benzene, benzoyl peroxide, isobutyl methacrylate, and several other chemically related monomers. Other chemicals used in the nail sculpturing process include titanium dioxide, benzoic acid, biphenyl, various aliphatic esters, diethyl phthalate, benzenethiol, diphenyl sulfide, and phenyl benzoate. The powder used for making sculptured nails is usually polymethyl methacrylate with benzoyl peroxide added as a catalyst. The liquid used is a mixture of one or more methacrylate ester monomers and a promoter. When the powder and the liquid combine, the chemicals react so that the monomer becomes a polymer by a process known as polymerization. Other nail-building products include gels that usually contain methacrylic or acrylic ester monomers, polyurethane, and a curing agent. These products require no mixing and are applied in a two-step process involving painting the gel on the nails and then"curing" the nail under visible or ultraviolet light or by an activator in the form of a spray.

One of the most dangerous chemicals used in making sculptured nails is liquid methyl methacrylate. This chemical was banned by the U.S. Food and Drug Administration (FDA) in 1974 for use in nail products due to its risk of causing cyanide poisoning. However, there are still many nail products that contain the chemical. Methyl methacrylate makes a very strong, paper-thin, natural looking nail. However, in the addition to the risk of cyanide poisoning, there are the less severe problems of severe skin irritation (including dystrophy of the nails) and dermatitis for both the client and the nail technician. Methyl methacrylate has been largely replaced in the marketplace with other methacrylate esters such as ethyl methacrylate, isobutyl methacrylate, and several other chemically related monomers. However, these products as well as other products that are used in the making of sculptured nails pose a substantial risk to both the client and the nail technician.

Some chemicals used to make artificial nails can be irritating to breathe. For example, overexposure to methyl methacrylate vapor may cause irritation of the nose, throat, and eyes. High concentrations of this chemical may cause central nervous system depression and unconsciousness. Also, headaches and pain in the extremities have been reported from exposure to the vapor. In addition, handlers of methyl methacrylate-containing cement have developed parathesias in the fingers. For ethyl methacrylate, there are no government-mandated exposure limits. However, it has been suggested that ethyl methacrylate is toxicologically similar to methyl methacrylate. Both chemicals are highly flammable and have an odor threshold of approximately 0.2 ppm (parts per million). Exposure to acetone can also cause irritation of the eyes, nose, and throat. At high concentrations, acetone can cause narcosis and central nervous system depression. Acetone is also highly flammable and volatile. Chronic exposure to benzene has produced irreversible injury to the blood-forming organs in humans while acute exposure to higher concentrations of benzene can cause irritation of the mucus membranes and central nervous system depression.

It is widely recognized that many of the chemicals used in nail sculpturing emit vapors which may be easily smelled because of their very low odor thresholds. For this reason, some states have strict ventilation requirements for nail salons and suggest that nail technicians use masks to minimize exposure to these chemicals and to trap the dangerous airborne dust that might be in the vicinity of their tables. Typically, when a nail technician is applying a set of sculptured nails, the technician sits on one side of a small table and the customer sits on the opposite side. Nail sculpturing is performed approximately one to two feet below the sculpturer's breathing zone. During this time, both the nail technician and the customer are exposed to any organic vapors and methacrylate dust generated by filing. Thus, this working environment is conducive to problems of odor and toxicity both for the nail technician and the customer. The problem has been particularly pronounced for nail technicians who work long hours breathing the fumes that come from the mixture of acrylic powders and liquids. Typical symptoms are headaches, sneezing, nausea and coughing.

The American Society of Heating, Refrigerating and Air-Conditioning Engineers ("ASHRAE") has responded to this health hazard by recommending building ventilation design criteria for beauty shops. ASHRAE Standard 62-1989, "Ventilation for Acceptable Indoor Air Quality." ASHRAE recommends outdoor air supply rates of 25 cubic feet per minute per person (cfm/person) for beauty salons. However, not all beauty salons are able to comply with these standards either because of limitations posed by the buildings in which they are housed or financial limitations. In addition, not all nail technicians and customers will be protected from adverse effects even if the ASHRAE standards and exposure limits set by governmental agencies were met. For example, some individuals may experience negative health effects as a result of individual susceptibility such as a preexisting medical condition, hypersensitivity, or an isolated allergic reaction. Furthermore, some substances may act in combination with other conditions in a beauty salon to produce negative health effects even if appropriate standards are met. Moreover, some chemicals are absorbed by direct contact with the skin and mucus membranes, and thus potentially increase the potential for adverse effects. Accordingly, there is a need for a system with reduces exposure to harmful fumes and vapors in the working environment of a nail salon.

U.S. Pat. No. 4,852,468 to Harris, entitled "Work Station With Fume Collecting Means" discloses an integrated, ventilated work station for nail technicians including a platform supported by pedestals, a transparent hood mounted on the platform, access slots on opposite sides of the transparent hood for insertion of the hands of a nail technician and a customer, ventilation slots for conveying heavier-than-air fumes downwardly through the platform, and a collector beneath the slots for collecting the fumes conveyed downwardly therethrough. The Harris work station also includes ducts and an exhaust fan for drawing the fumes from the vicinity of the sculpturing process. This Harris device, however, is somewhat impractical and relatively expensive to manufacture in that it comprises a complete work station. In practice, a nail technician usually applies sculptured nails to a customer while seated at a small table located in the nail salon. Theoretically, any convenient table with open surface space is acceptable. Also, it is desirable for a nail technician to be able to easily move his or her work station to various nail salons or the home of a customer.

Therefore, there is a need yet for an exhaust ventilation system which may be portable, inexpensive, and used to reduce the exposure to potentially harmful odors in the breathing zone of a nail technician who is working on the nails of a customer.

SUMMARY OF THE INVENTION

The present invention is directed to a portable apparatus for use with a source of reduced pressure for removing fumes and vapors from the work area of a nail technician, such as when applying sculptured nails. The invention comprises a transparent, generally convex hood which defines an interior chamber or an enclosure when the hood is placed on a flat surface. The hood has two pairs of openings positioned on opposite sides of the hood to accommodate the hands of a nail technician and a customer. The hood is comprised of two layers: an inner layer and an outer layer which is spaced apart from the inner layer so as to define a plenum between the two layers. The inner layer has several apertures or holes extending from the interior chamber to the plenum so that fumes and vapors in the interior chamber and plenum may be removed therefrom by connecting one or more outlet ports of the hood to the source of reduced pressure which draws fumes and vapors from within the interior chamber through the apertures, into and through the plenum, and out through the outlet port.

A filter may be placed between the outlet port and the source of reduced pressure so as to further assist in removing harmful odors from the breathing zone of the nail technician and the customer. The apparatus of the present invention may also be equipped with a light fixture for illuminating the interior chamber and an air freshener mounted on or in the source of reduced pressure so that the work area of the nail technician may be aromatized.

Thus, it is an object of the present invention to provide a means of minimizing the exposure to potentially harmful fumes and vapors during the application of sculptured nails.

It is another object of the present invention to provide a means of removing fumes and vapors associated with the application of sculptured nails which is lightweight, portable, and inexpensive to manufacture.

It is yet another object of the present invention to provide a means of complying with standards and regulations for air quality associated with beauty salons.

These and other objects, features, and advantages of the present invention will become apparent upon reading the following specification in conjunction with the accompanying drawing figures.

BRIEF DESCRIPTION OF THE DRAWINGS

FIG. 3 is a front sectional view of the nail technician's ventilator of the present invention as viewed from cutting plane line 3 of FIG. 1.

FIG. 4 is an exploded side view of the filter means of the present invention connected between the nail technician's ventilator of the present invention and a source of reduced air pressure as depicted in FIG. 1.

FIG. 5A is a side view of an air freshener which can be used in conjunction with the present invention by coupling the air freshener to an exhaust port of a source of reduced air pressure as illustrated in FIG. 1.

FIG. 5B is a top view of a lid portion of the air freshener shown in FIG. 4.

DETAILED DESCRIPTION OF THE PREFERRED EMBODIMENT

Figure 1:
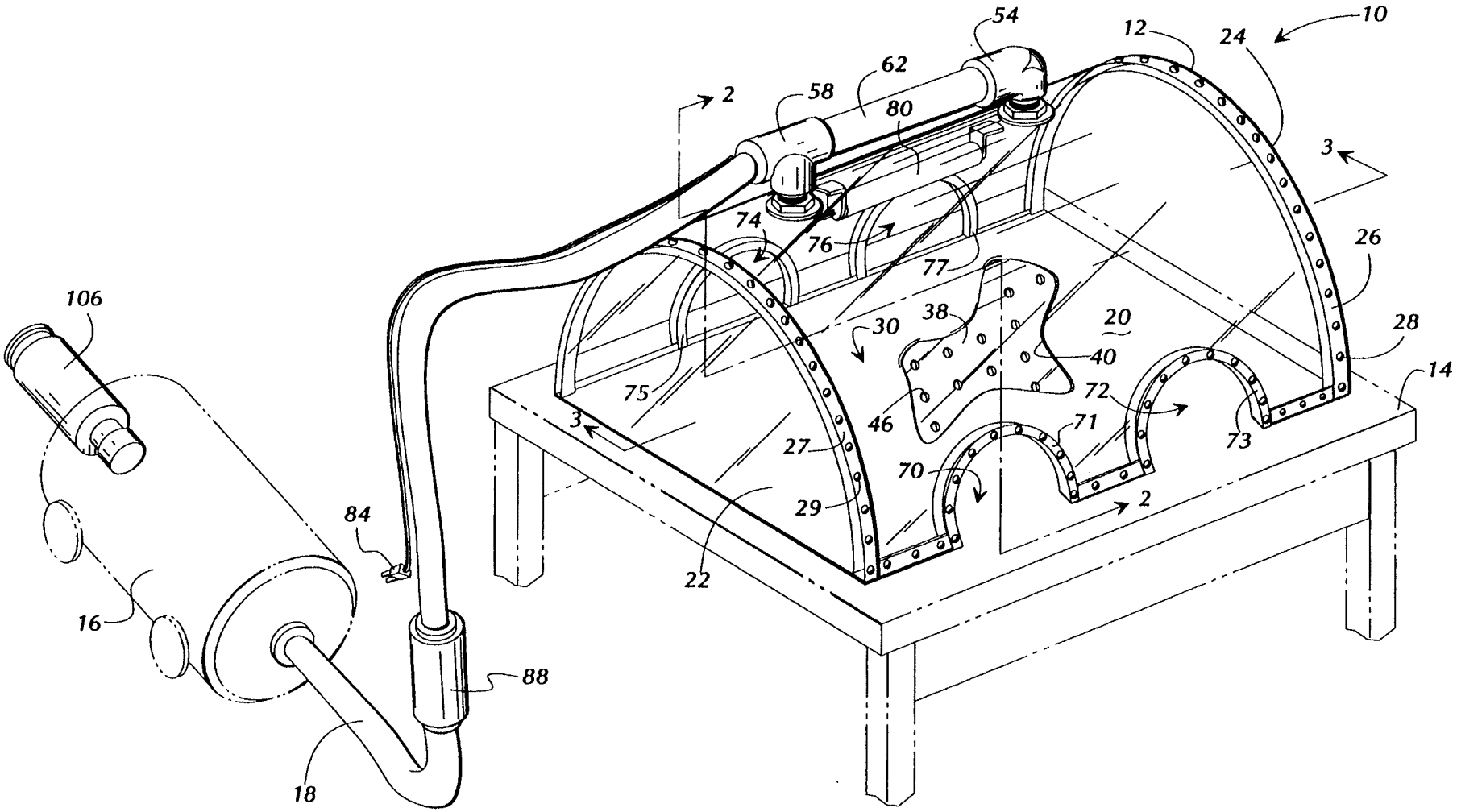
FIG. 1 is a perspective view of a preferred embodiment of the nail technician's ventilator of the present invention connected to a vacuum cleaner and placed on a small table.

Referring now to the drawings, wherein like reference numerals denote like parts throughout the several views, FIG. 1 shows the nail technician's ventilator 10 according to the present invention. The ventilator 10 includes a generally convex hood 12 which is connected to a source of reduced pressure or vacuum cleaner 16 by hose 18. Hood 12 is preferably a semicylindrical hood having a two-ply, semicylindrical side wall 20 and two semicircular end walls 22, 24 attached at opposite ends of side wall 20 so as to define an interior chamber or enclosure 30 when placed on a work surface such as table 14. The source of reduced pressure can be a generic household or industrial vacuum cleaner 16, however, any exhaust means which is capable of drawing fumes from interior chamber 30 is acceptable. Hose 18 may be any suitable flexible or rigid enclosed air passageway.

The use of a commercially available vacuum cleaner, on the one hand, has the advantages of portability, lower cost, and ready availability. On the other hand, one can use a central system installed in the building (if available) to exhaust the fumes entirely out of the work area (and maybe outside the building), providing greater effectiveness at the expense of cost and some portability.

Figure 2:
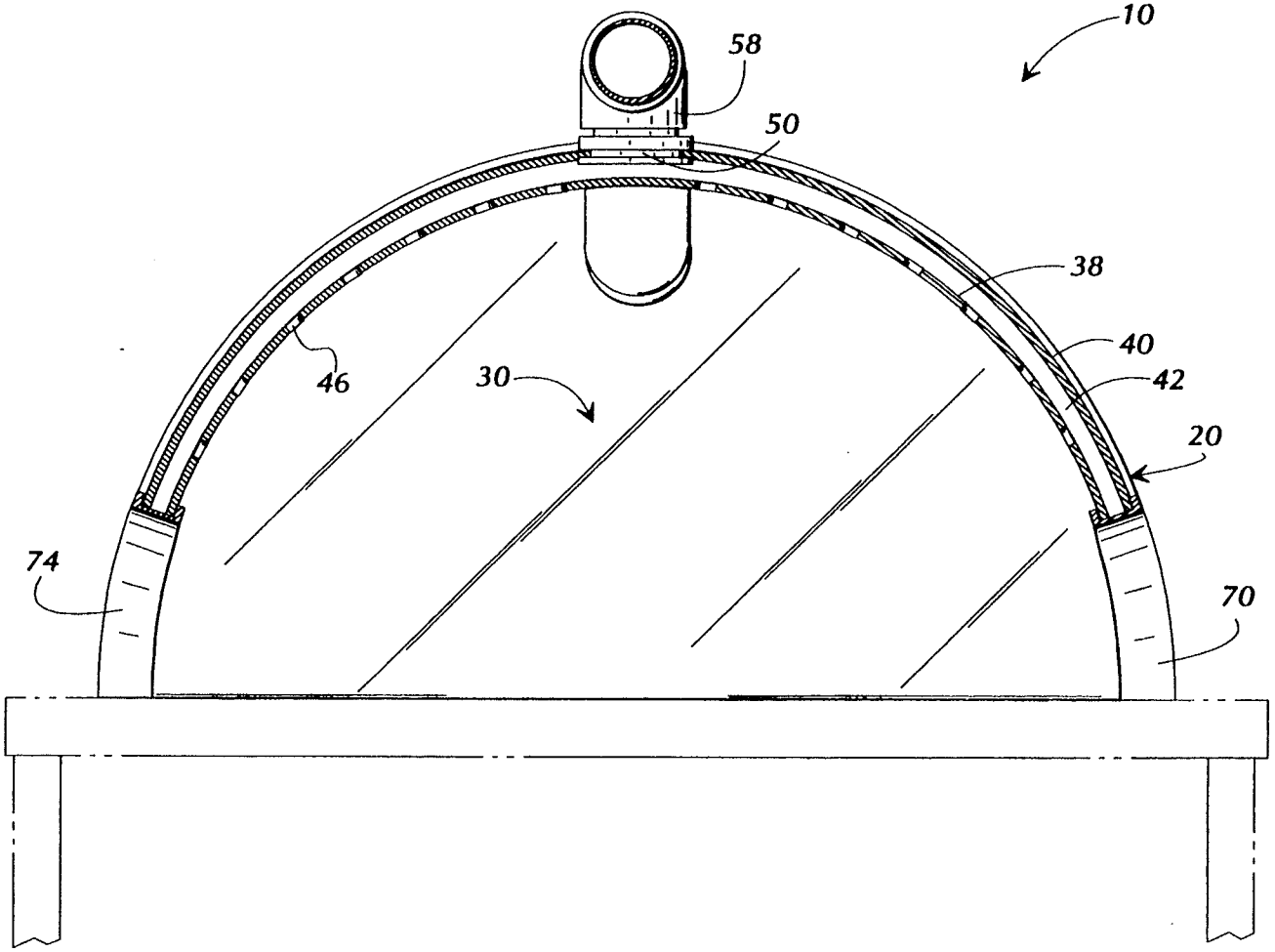
FIG. 2 is an offset side sectional view of the embodiment of the present invention depicted in FIG. 1 as seen from cutting plane line 2—2.

The side wall 20 of hood 12 has an inner layer 38 and an outer layer 40, both of which have four edges or portions 70, 72, 74, 76 defining semicircular openings or cutouts for the insertion of the hands of a nail technician and a customer. As shown in FIG. 2, inner layer 38 is spaced apart from outer layer 40 by a preselected distance so as to define a plenum 42 between the two layers 38, 40 of side wall 20. Inner layer 38 has a plurality of holes or apertures 46 extending from the interior chamber 30 to the plenum 42. When hood 12 is formed of a transparent material such as Plexiglas®, the apertures 46 of inner layer 38 are visible from the perspective view of FIG. 1. However, in an effort to more fully display other features of the present invention, apertures 46 are only illustrated in the cutout section on outer layer 40 in FIG. 1. The apertures 46 of the present invention are more fully depicted in the cross-sectional views of FIGS. 2 and 3.

As shown in FIG. 3, hood 12 also has two outlet ports 50, 52 which are in communication with the plenum 42 for drawing fumes and vapors from within the interior chamber 30 of the hood 12 through the apertures 46, into and through plenum 42, and out through the outlet ports 50, 52 when outlet ports 50, 52 are connected to the source of reduced pressure 16.

Referring again to FIG. 1, hood 12 is formed of a transparent material such as plastic or glass. However, Plexiglas® is preferable because of its light weight transparency, flexibility for formation into various sizes and shapes and because of its resistance to breakage. Any other suitable transparent material is acceptable, however. The inner layer 38 and outer layer 40 of semicylindrical side wall 20 are spaced apart and held in a fixed position by formed metal bands or strips 26, 27 attached by rivets or screws 28, 29 reinforced with glue or a sealant to provide additional support and to minimize air leakage from interior chamber 30. The formed metal bands 26, 27 also are used to attach semicircular end walls 22, 24 to opposite ends of semicylindrical side wall 20 so as to complete the enclosure defined by hood 12. In addition, formed metal strips 71, 73, 75, 77 are positioned around the two pairs of hand openings 70, 72 and 74, 76 positioned on opposite sides of the semicylindrical side wall 20 of hood 12. Although the hood described here with respect to the preferred embodiment of the present invention is constructed using formed metal bands or strips attached to Plexiglas® panels by rivets or screws, it will be clear to those skilled in the art that various other means of construction may be used such as forming the hood as a one-piece molded structure or attaching the walls of the hood 12 with an adhesive such as glue or any other suitable adhesive or bonding method.

FIG. 2 shows an offset side sectional view of hood 12 as viewed from cutting plane line 2—2 of FIG. 1. This view shows the plenum 42 which is formed by spacing inner layer 38 a preselected distance from outer layer 40. Also shown are a plurality of apertures 46 extending from the interior chamber 30 of hood 12 to the plenum 42. The apertures 46 are spaced along the extent of inner layer 38 so as to aid in complete and uniform removal of vapors and fumes from the interior chamber 30 of hood 12. As shown in FIG. 2, apertures 46 are generally equally spaced along the extent of inner layer 38. However, the apertures 46 may be strategically positioned so that there are more apertures 46 adjacent to the hand openings and fewer apertures 46 as one moves in the direction of outlet port 50. Such an arrangement provides increased suction at locations in interior chamber 30 which are farthest from the source of reduced pressure 16 and in the vicinity of hand openings 70, 72, 74, 76 where fumes and vapor are most likely to escape from the hood 12. However, leakage of fumes and vapors may be reduced by mounting flexible flaps (not shown) on the hand openings 70, 72, 74, 76.

Also shown in FIG. 2 is a cross-sectional view of outlet port 50 and its connection to the outer layer 40 of hood 12. Outlet port 50 is the means by which fumes and vapors are drawn from interior chamber 30 into plenum 42 via apertures 46 and exhausted when hood 12 is connected to a source of reduced pressure 16 (not shown). In the embodiment shown here, outlet port 50 is in communication with plenum 42 by means of an opening in the outer layer 40 of hood 12. However, it is equally acceptable to position an outlet port on end wall 22 or end wall 24 so long as the outlet port is in communication with plenum 42. Also, while two outlet ports are depicted, fewer or more outlet ports could be employed.

FIG. 3 is a side sectional view of the nail technician's ventilator 10 of the present invention as seen from cutting plane line 3 of FIG. 1. FIG. 3 further illustrates various features of the present invention. For example, outlet ports 50, 52 are shown in communication with plenum 42 and connected to each other by elbow connection 54, conduit 62, and T-connection 58 along with appropriate coupling means 56, 60 at outlet ports 50 and 52, respectively. Outlet ports 50, 52 are connected to a source of reduced pressure 16 via hose 18 by means of T-connection 58, conduit 62, and elbow connection 54 along with appropriate coupling means 56, 60 such as a nut and washer mounted on threads of T-connection 58 and elbow connection 54. Preferably, elbow connection 54, conduit 62, and T-connection 58 are made of polyvinylchloride (PVC), however, any suitable material such as metal, glass, plastic or the like may be used. FIG. 3 also shows a light 80 mounted on the inner layer 38 of side wall 20 by supports 82 using any convenient mounting means such as glue or any other adhesive, screws, rivets, and the like. Light 80 illuminates interior chamber 30 and is connected to a power source by a power cord 84.

FIG. 4 is an exploded view of the filter means 88 of the present invention connected in line with hose 18. Hose 18 has a first end which is connected to outlet port 50 via T-connection 58 and a second end which is connected to vacuum cleaner 16. Filter means 88 is preferably connected in line with hose 18 by cutting hose 18, fitting the portion of hose 18 which is adjacent the cut with couplers or bushings 90, 102 and connecting couplers 90, 102 to appropriately sized adapters 92, 100 so as to obtain an air tight connection between filter means 88 and hose 18. Alternatively, filter means 88 may be mounted between two separate prefabricated lengths of hose. In the preferred embodiment, filter means 88 comprises a generally cylindrical filter housing 96 with a screw-top lid portion 94 to which adapter 92 is attached. One or more filters 98, preferably made of sponge rubber or charcoal, are positioned in filter housing 96 as shown in the cutout section of FIG. 4. Filter means 88 assists in removing fumes and vapors from the air which is drawn from the interior chamber 30 of hood 12 and into hose 18 by vacuum cleaner 16. Filter 98 may be made of any fine porous substance which is capable of removing or trapping the molecular constituents of the potentially harmful fumes and vapors collected from the interior chamber 30 of hood 12 during the process of applying sculptured nails and performing other nail technician services. The filters 98 may be replaced by removing screw-top lid 94 from filter housing 96 which is preferably made of plastic.

FIG. 5A shows a side view of the air freshener means 106 of the present invention including a cutout showing air freshener 112 which may be made of sponge rubber or any other suitable material. Air freshener 112 may be moistened with any desired fragrance. Air freshener means 106 comprises a generally cylindrical exhaust air freshener housing 108 with a perforated screw-top lid portion 110 for aromatizing the work area of a nail technician when the air freshener means 106 is connected to a source of reduced pressure 16 having an exhaust port as shown in FIG. 1. Air freshener means 106 is connected to the exhaust of a source of reduced pressure 16 by means of a suitably sized adapter 114. FIG. 5B shows a top view of the perforated lid portion 110 of air freshener means 106. The perforated lid portion 110 may be perforated with any number of holes so as to control the amount of aroma provided to the work area of a nail technician. The air freshener 112 may be replaced by removing perferated, screw-top lid 110 from exhaust air freshener housing 108 which is preferably made of plastic.

OPERATION

In operation, the nail technician's ventilator 10 of the present invention is placed in service by placing hood 12 on a suitable work table 14 with a nail technician seated adjacent one pair of hand openings 70, 72 and a customer seated on the opposite side of the hood 12 adjacent a second paid of hand openings 74, 76, or vice versa. Hood 12 is then connected to a source of reduced pressure 16 via outlet ports 50, 52 and appropriate air ducts including elbow connection 54, conduit 62, T-connection 58, and hose 18 along with suitable coupling means 56, 60 at outlet ports 50 and 52, respectively. In addition, a filter means 88 may be connected in line with hose 18 and air freshener means 106 may be connected to the exhaust of a source of reduced air pressure 16. An optional light fixture 88 with power cord 84 and the source of reduced pressure 16 are then connected to a power source (not shown). When the source of reduced pressure 16 is turned on, harmful fumes and vapors associated with the application of sculptured nails and other processes performed by a nail technician are drawn from the interior chamber 30 of hood 12 through apertures 46 in inner layer 38 and into plenum 42. Fumes and vapors are then drawn from the plenum through outlet ports 50, 52 and into hose 18 via elbow connection 54, conduit 62, and T-connection 58. Fumes and vapors entering hose 18 are filtered by filter means 88 which is connected in line with hose 18 and the output of filter means 88 is drawn into the source of reduced pressure 16. Any remaining fumes and vapors at this point are further filtered by the internal structure of the source of reduced pressure which may include additional filter means if the source of reduced pressure 16 is a vacuum cleaner as in the preferred embodiment. Furthermore, air freshener means 106 provides additional filtering of any remaining fumes and vapors drawn from the interior chamber 30 of hood 12 and provides a pleasant aroma to the work area of a nail technician.

The nail technician's ventilator 10 of the present invention, thus described, provides a means of removing hazardous vapors and fumes from the work area of a nail technician by means of a generally convex hood for containing the fumes and vapors. The hood is connected by appropriate air passageways to a source of reduced pressure for drawing the contained fumes and vapors from the interior chamber of the hood. The nail technician's ventilator of the present invention is a self-contained unit which is portable and may be moved from location to location and placed in service by simply connecting it to a source of reduced pressure such as a vacuum cleaner. Because of the nail technician's ventilator of the present invention is preferably made of Plexiglas ®, it is lightweight (which aids in portability) and inexpensive to manufacture.

Because of the potential hazards associated with the application of sculptured nails and other processes performed by a nail technician, the United States government and various industry organizations have established standards and regulations for the beauty and cosmetic industry, particularly with respect to the application of sculptured nails. The present invention provides a means of assisting nail technician's in complying with these industry standards and regulations. Furthermore, and more importantly, the nail technician's ventilator of the present invention significantly reduces the exposure of nail technicians and customers to vapors and fumes of chemicals which have been associated with a multitude of health hazards.

Although the present invention has been described in considerable detail with reference to a preferred embodiment thereof, it will be obvious to those skilled in the art that many modifications, additions, and deletions may be made therein without departing from the scope and spirit of the invention as set forth in the following claims.

What is claimed is:

1. A nail technician's ventilator apparatus for use with a source of reduced pressure for removing fumes and vapors from the work area of a nail technician, said apparatus comprising: a transparent, generally convex hood for defining an interior chamber when placed on a work surface, said hood having a first portion defining a first pair of openings and a second portion defining a second pair of openings positioned generally opposite said first portion for the insertion of the hands of a nail technician and a customer into said interior chamber, said hood having an inner layer and an outer layer spaced from said inner layer by a preselected distance so as to define a plenum therebetween, said inner layer having a plurality of apertures extending from said interior chamber to said plenum, said hood having at least one outlet port in communication with said plenum for connection to the source of reduced pressure for drawing fumes and vapors from within said interior chamber through said apertures, into and through said plenum, and out through said at least one outlet port.

2. The apparatus as recited in claim 1 wherein said generally convex hood is shaped generally like at least a portion of a cylinder.

3. The apparatus as recited in claim 1 further comprising an air passageway connecting said at least one outlet port to the source of reduced pressure.

4. The apparatus as recited in claim 3 wherein said air passageway includes a filter means for removing or trapping fumes and vapors drawn from within said interior chamber of said hood.

5. The apparatus as recited in claim 1 wherein the source of reduced pressure is a vacuum cleaner having an exhaust port.

6. The apparatus as recited in claim 5 further comprising an air freshener means connected to the exhaust port of the vacuum cleaner for filtering and aromatizing the work area of a nail technician.

7. The apparatus as recited in claim 1 further comprising a light fixture mounted on said hood for illuminating said interior chamber of said hood.

8. The apparatus as recited in claim 4 further comprising an air freshener means for filtering and aromatizing the work area of a nail technician.

9. The apparatus as recited in claim 4 wherein said filter means comprises a generally cylindrical filter housing connected in line with said air passageway and having a screw-top lid portion and a filter element removably stored in said filter housing.

10. The apparatus as recited in claim 6 wherein said air freshener means comprises a generally cylindrical air freshener housing including a perforated screw-top lid portion defining a plurality of holes for aromatizing the work area of a nail technician through said holes when an air freshener element having a desired fragrance is positioned in said air freshener housing.

11. A nail technician's ventilator apparatus for removing fumes and vapors from the work area of a nail technician, said apparatus comprising: a transparent hood being generally shaped like a portion of a cylinder for defining an interior chamber when placed on a work surface, said hood having a first portion defining a first pair of openings and a second portion defining a second pair of openings positioned generally opposite said first portion for the insertion of the hands of a nail technician and a customer into said interior chamber, said hood having an inner layer and an outer layer spaced from said inner layer by a preselected distance so as to define a plenum therebetween, said inner layer having a plurality of apertures extending from said interior chamber to said plenum, a source of reduced pressure, said hood having at least one outlet port in communication with said plenum for connection to said source of reduced pressure for drawing fumes and vapors from within said interior chamber through said apertures, into and through said plenum, and out through said at least one outlet port.

12. A portable apparatus for removing fumes and vapors from the work area of a nail technician, said apparatus comprising: a transparent hood comprising a semicylindrical side wall, two semicircular end walls attached at opposite ends of said side wall so as to define an interior chamber when said hood is placed on a work surface, said side wall having an inner layer and an outer layer separated from said inner layer so as to define a plenum therebetween, said inner layer having a plurality of apertures extending from said interior chamber to said plenum, said outer layer having at least one suction port in communication with said plenum and in communication with a hose having an in-line filter means, said hose being connected to a source of reduced pressure having an exhaust port with an air freshener means attached thereto whereby fumes and vapors are drawn from within said interior chamber through said apertures; into and through said plenum, out of said plenum through said at least one suction port, into said hose, through said filter means, into and out of said source of reduced pressure via said exhaust port with said air freshener means attached thereto thereby deodorizing and aromatizing the work area of a nail technician.

* * * * *